United States Patent [19]

Womack et al.

[11] 4,192,393

[45] Mar. 11, 1980

[54] HELICOPTER PORTABLE EARTH DRILLING APPARATUS

[75] Inventors: D. Gene Womack, Littleton; Charles G. Hignight, Westminster, both of Colo.

[73] Assignee: Georex Industries, Inc., Westminster, Colo.

[21] Appl. No.: 933,807

[22] Filed: Aug. 15, 1978

[51] Int. Cl.² ..... E21B 1/08; E21B 5/00

[52] U.S. Cl. ..... 175/103; 60/718; 173/160

[58] Field of Search ..... 175/170, 171, 195, 103; 60/711, 718; 166/75; 173/22, 23, 27, 141, 160

[56] References Cited

U.S. PATENT DOCUMENTS

| | | | |
|---|---|---|---|
| 2,842,340 | 7/1958 | Burness | 173/27 |
| 3,047,080 | 7/1962 | Gunther, Jr. | 173/27 |
| 3,061,023 | 10/1962 | Samhammer, Jr. | 173/37 |
| 3,273,658 | 9/1966 | Ytterfors et al. | 173/141 |
| 3,568,779 | 3/1971 | Cannon | 173/160 |
| 3,825,075 | 7/1974 | Mee | 173/160 |
| 3,981,485 | 9/1976 | Eddy et al. | 60/718 |

*Primary Examiner*—James A. Leppink

*Attorney, Agent, or Firm*—Gary M. Polumbus

[57] ABSTRACT

A portable earth drilling apparatus adapted for helicopter transportation has been designed in light modular form and particularly adapted for use at high elevations under circumstances where prior art drill rigs are not capable of efficient operation.

1 Claim, 6 Drawing Figures

HELICOPTER PORTABLE EARTH DRILLING APPARATUS

BACKGROUND OF THE INVENTION

Helicopter portable drill rigs have been developed for use in remote locations where it is difficult to transport and locate more conventional earth drilling equipment. Examples of such helicopter portable drill rigs are (1) a drill rig marketed under the name Heli-Drill by Big Indian Drilling, Company, Ltd. of Calgary, Alberta, Canada, (2) a drill rig marketed under the name Midway Copter-Rig model 13MH by Midway Manufacturing and Supply, Inc., a subsidiary of Texas International Company of Odessa, Texas, and (3) a drill rig marketed under the name Mayhew Model 50 Portable Demountable Drill by Gardner-Denver of Dallas, Texas. Prior to the present invention, however, helicopter portable drill equipment has suffered from any one or more of several disadvantages which makes them unsuitable for drilling in hard rock at high elevations such as in the Rocky Mountains. The typical disadvantages of the prior art helicopter portable drill rigs are that they are so heavy that they require relatively large and expensive helicopter transportation making the drilling operation unduly expensive and they do not operate efficiently in the thin air prevelent at high altitudes.

The lack of a portable drill rig capable of operating efficiently at high altitudes is understandable since to design such a drill rig requires the blending of component parts which are capable of operating in thin air and yet which are light enough that they can be transported by smaller, relatively inexpensive helicopters.

The need for helicopter portable drill rigs which will operate at high altitudes has increased within the last decade due to the diminishing supply of petroleum products necessitating the search for these products in more remote areas, some of which are at high altitutes. The search for petroleum products frequently involves seismic exploration work prior to the drilling of an exploratory well with the seismic work typically being conducted with the use of dynamite explosions that set off sound waves through the earth's crust which are recorded by specially designed equipment to give the exploration company a better picture of the subsurface rock formation. For environmental reasons, it is desirable to set the explosive charge below the surface of the earth but this requires drilling shallow holes into which the dynamite charge can be placed and prior to the present invention economical portable drilling equipment suitable for drilling in hard rock at high elevations, such as in the Rocky Mountains, has not been available.

SUMMARY OF THE INVENTION

The helicopter portable drilling apparatus of the present invention was designed specifically for transportation by relatively small, inexpensive helicopters and for operation at high elevations where the air is relatively thin thus rendering prior art apparatuses inefficient. Utilizing the specifications of a particular helicopter which is small and relatively inexpensive in comparison to helicopters required to lift heavier portable rigs, the present invention was designed in modular form so that no module would weigh more than 1300 pounds at 10,000 feet elevation. The use of a larger helicopter capable of lifting heavier modules as used in prior art drilling equipment typically triples the expense for helicopter transportation and thus one can readily appreciate the advantages of a light drilling apparatus as in the case with the present invention.

Recognizing the weight limitations imposed on the drill rig, it was determined in the development of the present invention that it would be very difficult to put a customary amount of weight on the drill bit itself as is possible at lower elevations with heavier drilling equipment so a percussion type tool was selected for doing the actual drilling. The use of the percussion type tool necessitated a compressor package that would deliver enough air at 10,000 feet to produce the necessary air to run the percussion type tool. To overcome the thin air limitations, screw type compressors were selected to deliver enough pressure to run the percussion type drilling tool and these compressors are powered by a special industrial engine which was selected after experimentation with other power systems that did not prove efficient at elevations of about 10,000 feet. Further, it was difficult to generate enough air pressure to efficiently operate the percussion type drill tool as well as the other driving motors necessary to advance the drill bit into the earth. Accordingly, the preferred embodiment of the drill rig includes a separate hydraulic system for driving the motors which advance the drill bit into the earth saving all of the compressed air for use in the percussion type drill tool which in the preferred embodiment is carried on the lower end of the drill stem.

After much experimentation, the final preferred form of the drill rig of the present invention encompassed three modular components. The first component is a hollow tubular frame carrying a drill rig with the tubular frame serving as an air reservoir for the compressed air and the drill rig including means for rotating a drill stem while advancing the drill stem into the earth. The drill stem has a percussion type tool and a drill bit on its lower end for breaking the rock as the tool is advanced into the earth. The second module is a compressor package utilizing a pair of screw type compressors, a cooling system for the compressors and separator equipment adapted to separate the lubricant for the compressors from the air. The third module is the power package, which, as mentioned previously, includes a carefully selected industrial engine adapted to perform efficiently at high elevations. Either the power module or the compressor module includes a hydraulic pump and reservoir for operating the hydraulic components of the drill rig. Each module weighs less than 1300 lbs. At 10,000 feet elevation so that it is capable of transportation by a relatively inexpensive helicopter.

The apparatus of the present invention is capable of drilling holes up to fifty feet in depth in hard rock at relatively high elevations and can be transported by a relatively small helicopter type aircraft giving the apparatus a capability not previously available from prior art systems.

Other objects, advantages and capabilities of the present invention will become more apparent as the description proceeds when taken in conjunction with the accompanying drawings.

DESCRIPTION OF THE PREFERRED EMBODIMENT

The helicopter portable drilling apparatus 10 of the present invention is seen in an assembled condition in FIG. 4 and as will be explained in more detail later, the apparatus consists of three separable modules, (1) a frame-drill rig module 12, (2) a compressor module 14 and (3) a power module 16.

Figure 1:
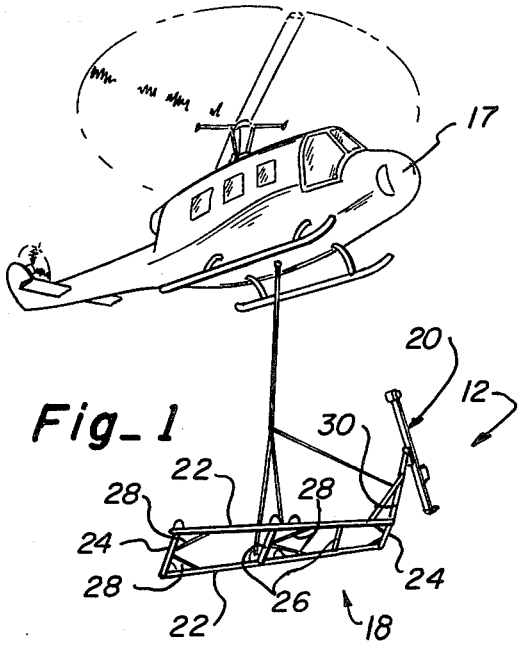
FIG. 1 is perspective view of a helicopter transporting the frame-drill rig module of the present invention.
Figure 2:
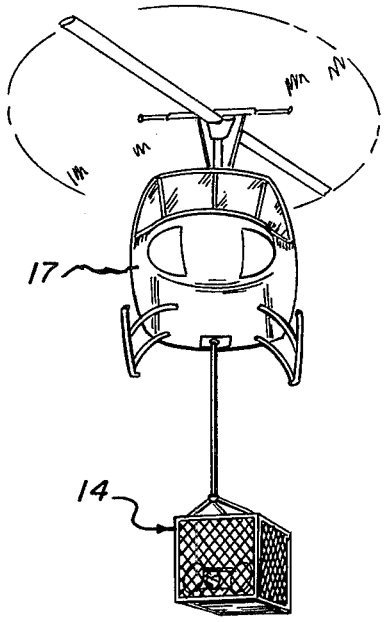
FIG. 2 is a perspective view of a helicopter transporting the compressor module of the present invention.
Figure 3:
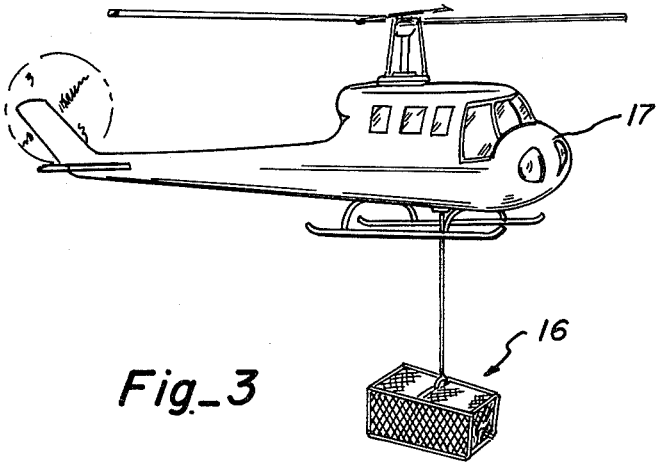
FIG. 3 is a perspective view of a helicopter transporting the power module of the present invention.

Each module has been designed to not only perform efficiently in enabling the drilling apparatus to drill holes up to fifty feet in depth at high altitutes in very hard rock, but has also been designed to weigh no more than 1300 lbs. so that they can be transported by an economically operable helicopter. Figs. 1 through 3 show the three separate modules being transported by a helicopter 17 and as will be explained later, the modules slide easily into the assembled condition of FIG. 4 so that once the frame-drill rig module 12 has been positioned on the ground, both the compressor and power modules 14 and 16 respectively can simply be lowered into place on the frame-drill rig module by the helicopter. The modules are then interconnected in a manner to be described later for operation of the apparatus.

Figure 4:
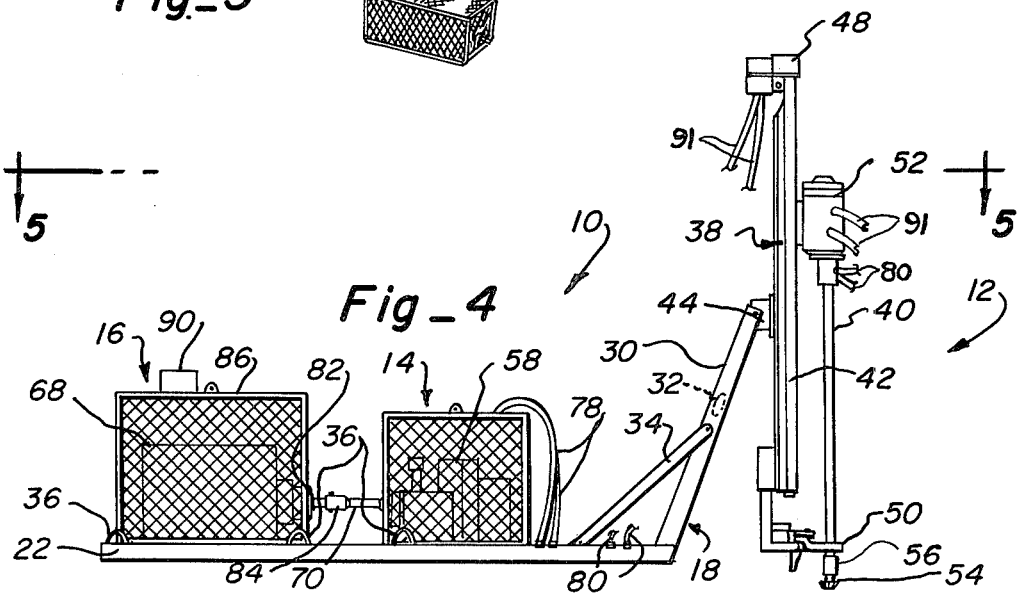
FIG. 4 is a side elevational view of the apparatus of the present invention.
Figure 5:
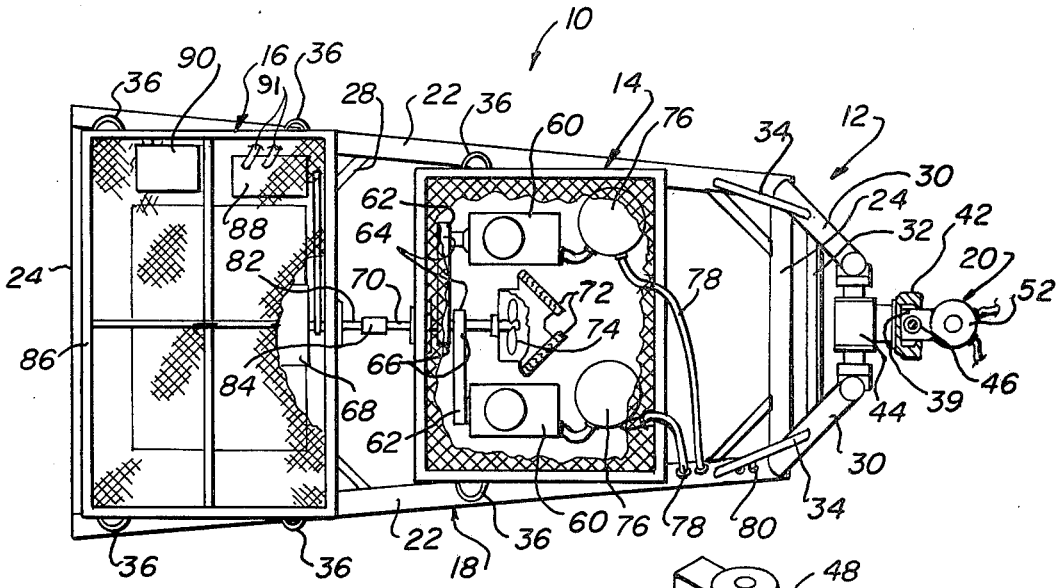
FIG. 5 is a top plan view of the apparatus of the present invention.
Figure 6:
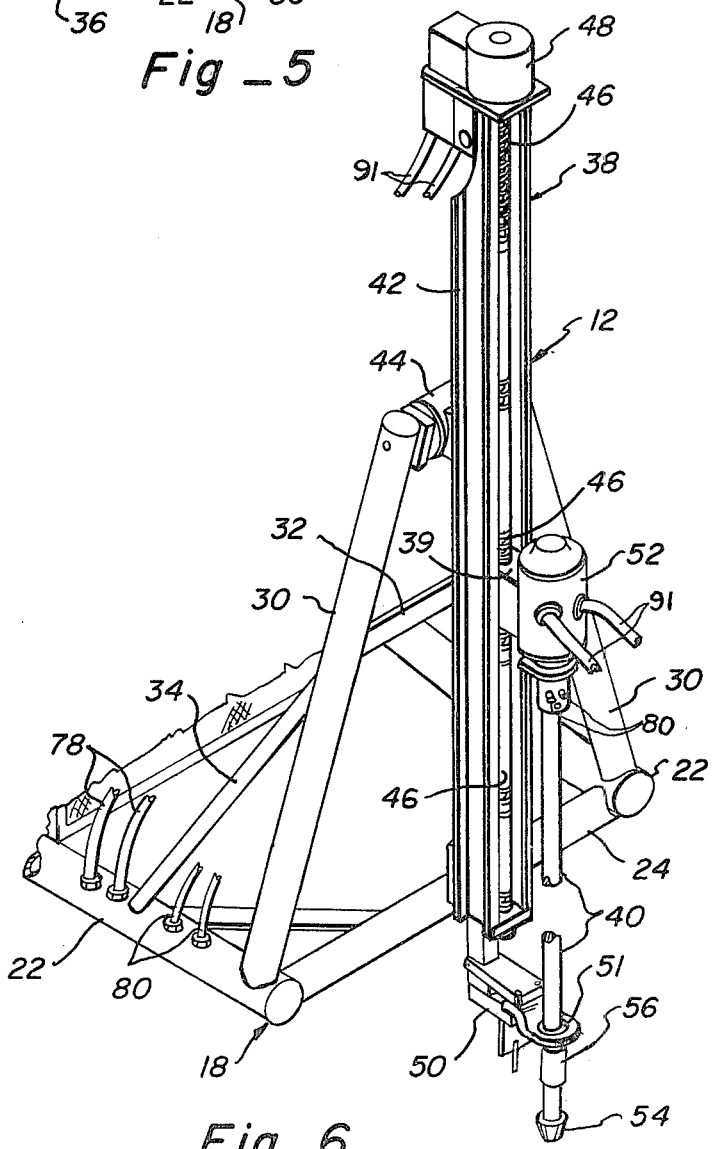
FIG. 6 is a fragmentary perspective view illustrating the drill rig utilized in the apparatus of the present invention.

The frame-drill rig module 12 is illustrated in FIGS. 2, 4 and 5 to include a base frame portion 18 and a drill rig 20 with the frame 18 supporting the drill rig in a vertical orientation at one end of the frame. The frame is of generally trapezoidal configuration on its bottom, as can be appreciated in FIG. 5, having a pair of longitudinal side frame members 22, a pair of end frame members 24 and two cross frame members 26 interconnecting the side frame members at positions between the two end frame members. Reinforcing struts 28 interconnect the side frame members with the end and cross frame members to reinforce the frame system. At the narrowest end of the frame 18, which will be referred to as the forward end, the frame includes a pair of riser frame members 30 which are inclined forwardly and inwardly in an upward direction to cooperate in forming the support-interconnect for the drill rig. The risers 30 are braced by a cross member 32 at a location approximately midway of their length and are braced in their upstanding position by strut members 34 interconnecting the risers with the side frame members 22.

The base frame 18 is also provided along its perimeter with triangular shaped guides 36 which serve to guide the compressor and power modules 14 and 16 respectively into position on the frame-drill rig module 12 when the compressor and power modules are lowered as by the helicopter 17 onto the frame. Once in position, the compressor and power modules are properly oriented for interconnection and do not need to be mechanically connected to the frame-drill rig module to hold their positions during operation.

The drill rig 20 includes a screw feed mast 28 and drill stem tubing 40 connected to the mast with three separate power systems adapted to cooperate in advancing the drill stem into the earth as a hole is being drilled. The mast 38 in the preferred form is a commercially available item manufactured and sold by Gardner-Denver of Dallas, Texas under the designation 2 MSUC Aluminum Shell Screw Feed Mounting. This mast basically consists of a channel member 42 extending vertically and being connected to the frame 18 of the apparatus by suitable connection means 44 which are mounted at the upper end of the risers 30. A threaded screw rod 46 is rotatably mounted within the channel member 42 and is operably connected to a drive motor 48 mounted on the upper end of the channel member. The drive motor 48 serves to selectively and reversibly rotate the screw rod 46 to move the drill stem vertically as will be explained later.

The lower end of the mast 38 has a bracket member 50 with a vertical opening (not seen) therethrough adapted to slidably receive the drill stem tubing 40. The drill stem tubing extends through the bracket 50 so that the drill stem can be guided into the hole during the drilling operations. The upper end of the drill stem tubing is operably connected to a hydraulic rotary motor 52 which is adapted to rotate the drill stem tubing during drilling operations. The rotary motor itself is operably connected to the screw rod in the drill mast so that as the drive motor at the top of the drill mast is driven to rotate the screw rod, the rotary motor can be advanced up or down the drill mast as desired. Of course, during advancement of the rotary motor up and down the drill mast, it in turn can rotate the drill stem to optimize drilling operations in a conventional manner.

The lower end of the drill stem 40 carries a conventional percussion type drill bit 54 which is the most effective type of drill bit when heavy weights cannot be put on the bit.

An air hammer 56, such as of the type manufactured by TRW-Mission of Houston, Texas under the designation A-3015 Down Hole Air Hammer, is incorporated at the lower end of the drill stem 40 immediately above the percussion type drill bit 54. The air hammer is adapted to deliver repeated reciprocating blows to the drill bit so that the bit can chip away at rock in the process of drilling a hole in the earth.

The rotary motor 52 rotates the air hammer 56 and drill bit 54 to facilitate the drilling operation. Of course, as the hole progresses in depth, the drive motor 48 at the top of the mast 38 is selectively operated to apply pressure to the drill bit by urging and advancing the rotary motor downwardly which in turn forces the drill stem, air hammer and bit downwardly. The travel length of the mast 38 is only approximately five to six feet so in order to get holes up to fifty feet in depth, lengths or sections of drill tubing are added in a conventional manner as the hole progresses in depth. In other words, an initial hole of five or six feet will be drilled by operating the air hammer, rotary motor and drive motor. After the five or six foot depth has been reached, the drive motor 48 will be reversed to lift the rotary motor 52 so that a second length of tubing can be added to the first length of tubing whereupon a second drilling operation is commenced which in effect deepens the hole another five or six feet before subsequent lengths of tubing are added in a similar manner.

Referring now to FIGS. 2, 4 and 5, the compressor module 14 can be seen to include a generally box-like framework 58 supporting a pair of compressors 60 mounted in side by side relationship at opposite sides of the module. At altitudes of approximately 10,000 ft. it is very difficult to obtain enough volume and pressure from a compressor to operate a drilling rig as in the present invention. Accordingly, a special screw-type compressor which will operate at high altitudes with more efficiency than typical compressors is utilized in the apparatus. An example of such a screw type compressor is a model BESG-A Electra-Screw R compressor manufactured by Gardner-Denver Company of Dallas, Texas. Two of these compressors are utilized in the apparatus of the present invention but one compressor could be utilized if it were large enough to give the volume and pressure necessary to operate the drilling rig and meet the weight limitations of the modules of the apparatus. The compressors 60 are mounted so that the rearward ends thereof have an input pulley 62 which is connected by a V-belt 64 to a drive pulley 66 which is in turn connected to the engine 68 for the apparatus as will be described later. The drive pulleys 66 are rotatably mounted in the compressor module in any suitable manner so that they can be easily connected to the engine 68 and transfer rotary motion to the screw type compressors. At the center of the compressor module, cooling radiators 72 are disposed in front of a fan 74 which is connected on the main drive shaft 70 with the drive pulleys 66 so that cooling fluids can be circulated through the radiators 72 and the compressors 60 to keep the temperatures of the compressors at an operating level. The cooling radiators are conventional and therefore will not be described in detail. Suffice it to say that cooling fluids are circulated through the radiators and the compressors with air being blown through the radiators by the fan to keep the cooling fluids at a desired temperature.

A pair of separator tanks 76, connected to the output from the compressors 60, are positioned in the compressor module 14 immediately in front of the compressors with the separators 76 also being a commercially available item adapted to separate air from the lubricant fluids utilized in the screw type compressors.

Flexible conduits 78 extend from the separators 76 to the hollow tubular main frame 18 of the frame-drilling module so that the compressed air can be stored in the main frame. It can, therefore, be said that the main frame 18 serves as an air reservoir for the compressed air utilized in the operation of the apparatus. Flexible conduits 80 also extend from the main frame 18 to the top of the drill stem 40, which is in fluid communication with the air hammer 56 and suitable valves (not shown) are provided so that air can be selectively delivered to the air hammer from the air reservoir.

The power module 16 of the apparatus 10 was also carefully designed so that it satisfied the weight limitations imposed by the helicopter parameters and so that it would deliver sufficient power at 10,000 ft. to adequately drive the air compressors 60 and a hydraulic pump which will be described later. The engine 68, is a Chrysler 318 industrial engine and was selected after considerable experimentation. The output shaft 82 of the engine is connected to the drive shaft 70 for the drive pulleys 66 in the compressor module 14 by a conventional universal coupling 84. Gasoline tanks (not shown) necessary to operate the engine are located outside the power module and transported separately due to weight.

The power module includes a frame structure 86 and a hydraulic system including a pump 88 and hydraulic fluid reservoir 90. The hydraulic pump 88 is disposed immediately adjacent the output of the engine 68 so that it is driven by the engine drive shaft 82 and the hydraulic fluid reservoir 90 is positioned on top of the power module framework 86 in a convenient location. The hydraulic fluid is utilized to drive both the drive motor and rotary motor 52 on the drill rig and suitable fluid conduits and valves (not shown) connect the hydraulic pump to the drive and rotary motors. As mentioned previously, the hydraulic pump and reservoir could be mounted on the compressor module if weight limitations parmitted. Since the hydraulic system is conventional a detailed description thereof is not deemed necessary. Suffice it to say that the drive motor and rotary motor are operable separately from each other in both forward and reverse directions to enable the efficient and effective operation of the drill apparatus.

Utilizing the equipment described above, it is possible to obtain air pressures of approximately 150 PSI with a volume of 200–300 CFM at altitudes of approximately 10,000 ft and also to generate sufficient hydraulic pressure to supplement the air pressure in efficiently drilling holes in relatively hard rock at high elevations to depths of up to fifty feet. The capabilities derived from the apparatus of the present invention are having a marked effect on seismic operations at high elevations which previously had to be carried out with surface explosions which do not give as accurate a reading as the subsurface seismic work possible with the apparatus of the present invention. Further, numerous environmental problems encountered with surface explosions utilized previously in seismic work at high elevations can be avoided due to the capabilities of the apparatus of the present invention.

Although the present invention has been described with a certain degree of particularity, it is understood that the present disclosure has been made by way of example and that changes in details of structure may be made without departing from the spirit thereof.

I claim as my invention:

1. An air portable earth drilling apparatus comprising in combination, a first module weighing less than 1300 lbs including a base frame having hollow tubular frame members adapted to store compressed air, and a drill rig secured to said base frame, said drill rig including a vertically oriented mast having a threaded rod extending along its length and motor means for reversibly rotating said threaded rod, a drill stem made of hollow tubing, second motor means operably connected to said threaded rod and drill stem so as to be movable vertically along said threaded rod while selectively imparting rotational movement to said drill stem, percussive type motor means connected to the lower end of said drill stem, and a drill bit operatively connected to the percussive type motor means, a second module weighing less than 1300 lbs including a framework, compressor means and a cooling system for cooling the compressor means, a third module weighing less than 1300 lbs including an internal combustion engine, connection means for operably interconnecting the engine with the compressor means and the compressor means with said hollow frame members and percussive type motor means, and a hydraulic system on said third module, and means operably interconnecting the hydraulic system with said first mentioned and second motor means.

* * * * *